United States Patent [19]

Kiriyama et al.

[11] Patent Number: 4,465,648

[45] Date of Patent: Aug. 14, 1984

[54] METHOD FOR REPAIRING REFRACTORY WALL OF FURNACE

[75] Inventors: Takashi Kiriyama; Chiyomi Yamaguchi, both of Kamaishi, Japan

[73] Assignee: Nippon Steel Corporation, Tokyo, Japan

[21] Appl. No.: 401,990

[22] Filed: Jul. 26, 1982

[51] Int. Cl.[3] ..... F27D 1/16

[52] U.S. Cl. ..... 264/30; 264/35; 264/36; 249/94; 425/13

[58] Field of Search ..... 264/30, 35, 36, 274, 264/328.2, 328.12; 249/91, 94; 425/13, 571

[56] References Cited

U.S. PATENT DOCUMENTS 503,079 8/1893 Gowen ..... 264/30 X

FOREIGN PATENT DOCUMENTS 51-1203 1/1976 Japan .

54-140006 9/1979 Japan .

*Primary Examiner*—Donald E. Czaja

*Assistant Examiner*—V. Fischbach

*Attorney, Agent, or Firm*—Wenderoth, Lind & Ponack

[57] ABSTRACT

Method for repairing the damaged refractory lining wall of a blast furnace which includes cutting an opening through the steel shell and the refractory bricks of the furnace, inserting an injection nozzle for injecting a repair material into the opening, the injection nozzle being provided with a plurality of reinforcing studs, injecting the repair material into the furnace under pressure via the injection nozzle, and simultaneously imparting an external force onto the plurality of reinforcing studs to automatically build up a repaired refractory brick having the reinforcing studs imbedded therein.

3 Claims, 7 Drawing Figures

FIG. 4(a)
FIG. 4(b)
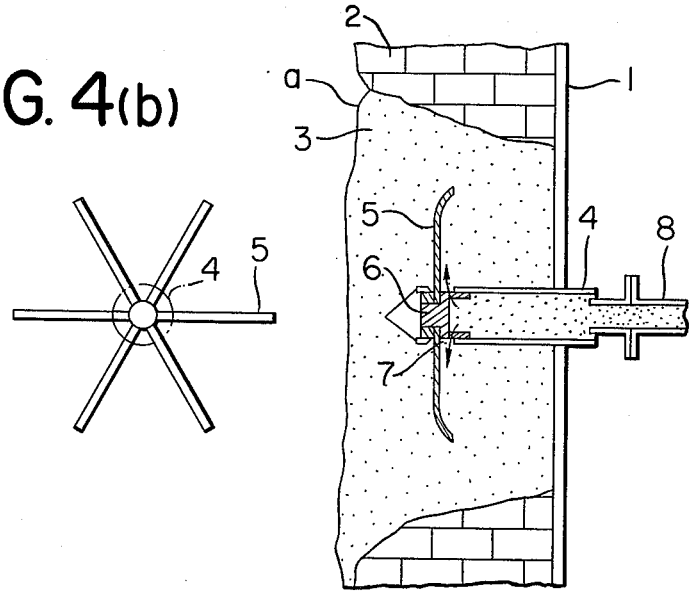
FIG. 5(a)
FIG. 5(b)
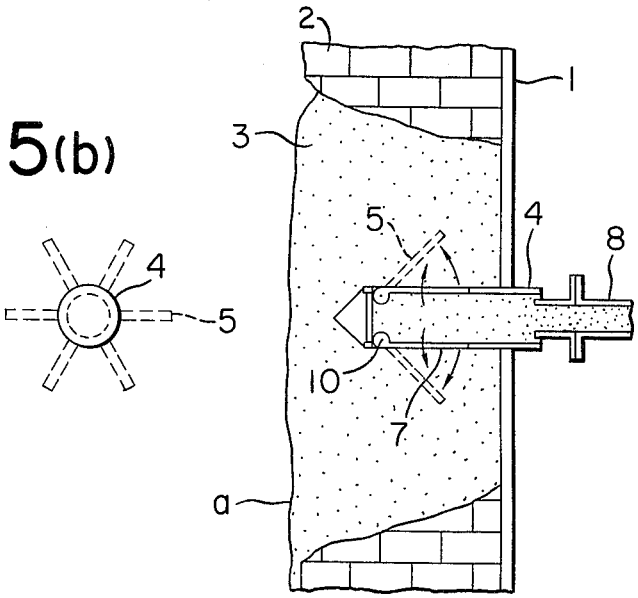

METHOD FOR REPAIRING REFRACTORY WALL OF FURNACE

BACKGROUND OF THE INVENTION

1. Field of the Invention

The present invention relates to a method for repairing the refractory lining wall of a furnace, and more particularly to a method and apparatus for repairing the refractory lining wall of a blast furnace.

2. Description of the Prior Art

As is well known in the iron and steel industry, the wall of a blast furnace is composed of refractory bricks which line the inside of the steel shell of the blast furnace. The refractory bricks of this wall suffer considerable wear from contact with the furnace charge and the molten pig iron in the furnace.

Various methods and means for repairing the above-mentioned worn refractory bricks have heretofore been proposed. The repair of the refractory lining walls of blast furnaces has been carried out by injecting a repair material in a hot or cold state into the spot to be repaired in the furnace. The repair material can be divided into the following types: heat setting, hydraulic setting, and chemical setting. When the repair material is to be introduced under pressure in a hot state, a heat setting material is generally used, and when the material is to be introduced in a cold state, either a hydraulic setting or a chemical setting material is used. It is particularly important that the refractory composition of the repair material have excellent fluidity so as not to clog in an injector or hose. Ordinarily a refractory composition of either the clay or alumina type is used.

The conventional prior art methods for repairing the refractory lining wall of a furnace can be listed as follows:

(1) Placing an injection pipe on the outer shell of the furnace and injecting a repair material under pressure therethrough (FIG. 1).

(2) Inserting an injection nozzle for the repair material through the desired part of the furnace wall and extending into the furnace and injecting a repair material under pressure which is ejected from the nozzle within the furnace in directions perpendicular to the injection nozzle (FIG. 2).

The methods (1) and (2) have the common disadvantage that, since no reinforcing studs are provided, the repaired portion of the refractory lining is apt to peel or fall out so that the repaired refractory lining has only a short service life.

SUMMARY OF THE INVENTION

It is the principal object of the present invention to provide a method for repairing the refractory wall of a blast furnace wherein a plurality of reinforcing metal studs are automatically incorporated into the repair material at the time the repair material is introduced under pressure.

It is another object of the invention to provide an apparatus for carrying out the method of repairing the refractory lining wall of a blast furnace from the outside thereof whereby the repair can be carried out through an opening of minimal size in the outer steel shell and the refractory lining wall of the furnace, in a simple manner and in a short time.

BRIEF DESCRIPTION OF THE DRAWINGS

Other and further objects of the invention will become apparent to those skilled in the art from the following detailed description of the invention with reference to the annexed sheets of drawings, in which:

FIGS. 4(*a*) and 4(*b*) are explanatory views showing a plurality of reinforcing studs are radially spread out or developed, FIG. 4(*a*) being a longitudinal sectional view of the nozzle and FIG. 4(*b*) being a horizontal sectional view thereof;

FIGS. 5(*a*) and 5(*b*) are explanatory views of another embodiment of the invention, FIG. 5(*a*) being a longitudinal sectional view of the nozzle and FIG. 5(*b*) being a side view thereof.

DETAILED DESCRIPTION OF THE INVENTION

The present invention relates to a method for repairing the refractory lining wall inside a blast furnace and an apparatus for carrying out this method in which, by incorporating a plurality of movable reinforcing studs into the repair material at the same time that the repair material is injected into the inside of the furnace, it is possible to carry out repair operation through minimum size openings in the steel shell and the refractory lining wall, to carry out the repair operation easily from a remote point outside the furnace, and to provide reinforcing studs integrally with the repair material which firmly retain the repaired portion of the wall, whereby the defects of the conventional repair methods are eliminated and a long service life for the blast furnace is assured.

More specifically, the present invention is characterized by the novel idea of providing an injection nozzle for injecting the repair material with a plurality of reinforcing studs, inserting the injection nozzle through an opening in the steel shell of the furnace at the spot to be repaired in the furnace, injecting the repair material into the furnace via the injection nozzle, and at the same time radially spreading out the forward ends of the reinforcing studs of the injection nozzle into the repair material by an external force to firmly hold the repair material.

A preferred embodiment of the invention will be described in more detail hereinbelow with reference to the accompanying drawings.

Figure 1:
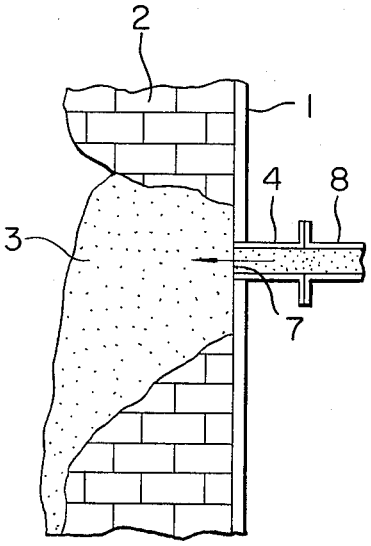
FIG. 1 PRIOR ART
FIG. 1 is a longitudinal sectional view of a conventional repair method of the prior art.
Figure 2:
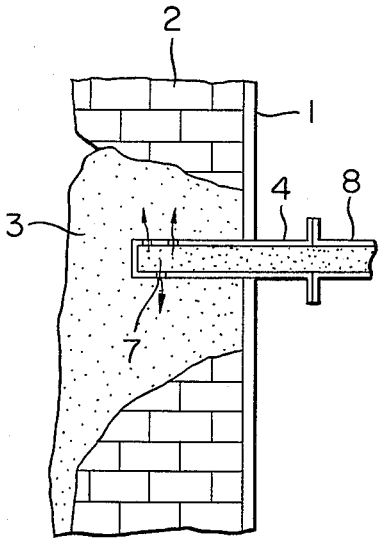
FIG. 2 PRIOR ART
FIG. 2 is a longitudinal sectional view of another conventional repair method.
Figure 3:
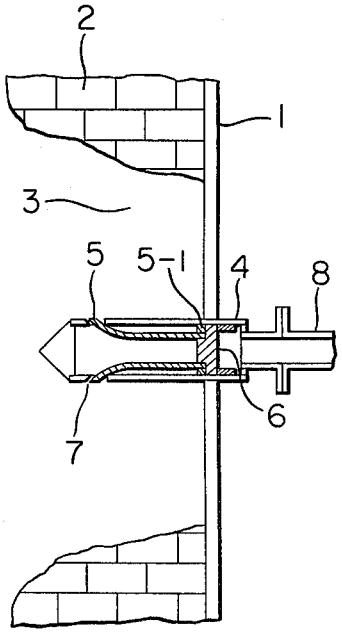
FIG. 3 is a longitudinal sectional view of an injection nozzle in accordance with a preferred embodiment of the invention wherein the injection nozzle is fixed on the furnace shell.

Referring to FIG. 3, an opening is cut through the outer steel shell 1 of the blast furnace, more precisely, through both the steel shell and the refractory bricks which line the furnace, and an injection nozzle 4 with a plurality of built-in movable reinforcing studs 5 is inserted into the opening and firmly fixed to the outer steel shell 1.

The injection nozzle 4 of the invention has a pointed conical head as shown in the drawings suitable for being inserted into the furnace via the opening, and its other end is open so that a repair material can be introduced under pressure thereinto. A plurality of discharging outlets 7 open laterally out of the nozzle 4 near the pointed conical head in the direction perpendicular to the horizontal axis of the nozzle 4.

Preferably, the reinforcing studs 5 collectively form a cylindrical body similar in shape to the injection nozzle, and each is provided with a flange 5-1 at one end thereof. The forward tips of the studs 5 point outward as shown in the drawings so as to fit easily into the discharging outlets 7. The studs 5 are freely slidable within the injection nozzle 4.

The repair material is forcedly delivered into the injection nozzle 4 via an injection pipe 8 by an injection pump (not shown), and pushes against a piston 6 provided within the nozzle 4 causing the piston 6 to move forward so as to push the reinforcing studs 5 forward. As a result, the studs 5 are radially pushed out of the discharging outlets 7 provided in the side of the injection nozzle 4 in the direction perpendicular to the horizontal axis of the nozzle 4. The studs are thus radially spread out (FIG. 4(*b*)) and are firmly fixed at a predetermined position as shown in FIG. 4(*a*).

The piston 6 has discharge outlets (not visible in the drawings) arranged to register with the discharge outlets of the injection nozzle 4 when the piston reaches the lefthand end position in FIG. 5(*b*), whereby, the repair material is forcedly introduced into the spot 3 to be repaired so as to form a repaired refractory brick wall portion having the reinforcing studs imbedded therein. In FIG. 4(*a*), the line a indicates an imaginary boundary between the charge of the blast furnace and the repaired brick wall.

Thus, in accordance with this invention, the repair of the damaged refractory lining wall of a blast furnace is carried out using a repair apparatus having a plurality of internal reinforcing studs which are caused to protrude from the discharge outlets of the injection nozzle by the pressure of the repair material.

Moreover, in accordance with this invention, it is also possible to use a repair material injection nozzle provided at some part thereof with a plurality of studs arranged to spread outwardly under the pressure of the repair material.

FIG. 5 shows such an embodiment of the invention, wherein a plurality of reinforcing studs are pivotally mounted on respective pivots 10. Accordingly, when pressure is exerted on the repair material 3 in the nozzle, it is exerted on each stud and each stud 5 rotates about its pivot so as to radially spread out into the furnace as shown by dotted lines and be incorporated into the repair material being ejected from the nozzle through the spaces left by the pivoting studs.

It should be noted that by varying the angle and shape of the reinforcing studs 5 as well as the angle of the discharge outlets of the piston 6 and the nozzle 4, it is possible to control the angle of discharge of the repair material into the furnace.

In the foregoing, the present invention has been described in connection with reinforcing studs which are spread by the pressure of the repair material. It should be understood, however, that the present invention is not limited to such spreading means and can employ any of various other types of external force to spread the studs.

As fully described in the foregoing, the present invention provides a method for repairing the refractory lining wall inside a blast furnace and an apparatus for carrying out the method in which, by incorporating a plurality of movable reinforcing studs into the repair material at the same time that the repair material is injected into the inside of the furnace, it is possible to carry out repair operation through openings in the steel shell and the refractory lining wall of minimal size, to carry out the repair operation easily from a remote point outside the furnace, and to provide reinforcing studs integrally with the repair material which firmly retain the repaired portion of the wall, whereby the defects of the conventional repair methods are eliminated and a long service life for the blast furnace is assured.

We claim:

1. A method for repairing the refractory brick lining on the inside of an outer metal wall of a blast furnace by filling a hole worn in the lining with a repair material, which method comprises the steps of:

inserting an injection nozzle through the outer metal wall from the outside of the furnace into the hole in said lining, placing a plurality of reinforcing studs in said injection nozzle in a manner for permitting them to spread out from said injection nozzle into substantially radially extending positions; and injecting repair material under pressure into said injection nozzle and against said reinforcing studs for spreading said reinforcing studs to said radially extending positions, the injecting repair material also being forced from said nozzle into said hole for filling said hole with said reinforcing studs embedded in said thus injected repair material.

2. A method as claimed in claim 1 in which said reinforcing studs are placed in said injection nozzle for moving along said nozzle and then through apertures at the end of the nozzle and radially outwardly of the nozzle, and said step of injecting the repair material into the nozzle against said reinforcing studs comprises injecting the repair material against the ends of the studs at the outer end of the nozzle for urging them along said nozzle.

3. A method as claimed in claim 1 in which said reinforcing studs are placed in said injection nozzle for pivoting movement so as to swing outwardly from said nozzle to said radially extending position, and said step of injecting the repair material into the nozzle against said reinforcing studs comprises injecting the repair material against the sides of the studs for swinging the studs outwardly.

* * * * *